US011251515B2

(12) United States Patent
Hashiguchi

(10) Patent No.: US 11,251,515 B2
(45) Date of Patent: Feb. 15, 2022

(54) ANTENNA

(71) Applicant: JAPAN AVIATION ELECTRONICS INDUSTRY, LIMITED, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 134 days.

(21) Appl. No.: 16/784,500

(22) Filed: Feb. 7, 2020

(65) Prior Publication Data

US 2020/0335849 A1 Oct. 22, 2020

(30) Foreign Application Priority Data

Apr. 17, 2019 (JP) ..... JP2019-078218

(51) Int. Cl.

| | |
|---|---|
| ***H01Q 1/38*** | (2006.01) |
| ***H01Q 1/22*** | (2006.01) |
| ***H01Q 9/04*** | (2006.01) |
| ***H01Q 1/36*** | (2006.01) |

(52) U.S. Cl.

CPC ..... *H01Q 1/22* (2013.01); *H01Q 1/36* (2013.01); *H01Q 9/045* (2013.01)

(58) Field of Classification Search

CPC ..... H01Q 1/22; H01Q 9/045; H01Q 1/36; H01Q 7/00; H01Q 1/1207

See application file for complete search history.

(56) References Cited

U.S. PATENT DOCUMENTS

| | | | | |
|---|---|---|---|---|
| 7,113,143 | B2 | 9/2006 | Minemura | |
| 9,502,761 | B2 | 11/2016 | Itoh et al. | |
| 10,211,541 | B2 | 2/2019 | Sano et al. | |
| 2006/0001575 | A1 | 1/2006 | Jo et al. | |
| 2007/0176827 | A1 | 8/2007 | Itoh et al. | |
| 2009/0027275 | A1* | 1/2009 | Su | H01Q 7/00 343/700 MS |

(Continued)

FOREIGN PATENT DOCUMENTS

| | | |
|---|---|---|
| JP | 2005-203854 A | 7/2005 |
| JP | 2016-225956 A | 12/2016 |

(Continued)

OTHER PUBLICATIONS

Office Action in U.S. Appl. No. 16/848,898, dated Mar. 26, 2021.

(Continued)

*Primary Examiner* — Dieu Hien T Duong

(74) *Attorney, Agent, or Firm* — Collard & Roe, P.C.

(57) ABSTRACT

An antenna comprises a main portion, a facing portion, a first feed terminal and a second feed terminal. The main portion has a ring shape with a split. The main portion has a first end portion and a second end portion. The first end portion and the second end portion are positioned away from each other in a right-left direction with the split left therebetween. The facing portion includes a first facing portion and a second facing portion. The first facing portion and the second facing portion are spaced away from each other. The first facing portion has an upper facing portion and a lower facing portion. The second facing portion is interposed between the upper facing portion and the lower facing portion in an up-down direction perpendicular to the right-left direction.

4 Claims, 5 Drawing Sheets

(56) References Cited

U.S. PATENT DOCUMENTS

| | | | | |
|---|---|---|---|---|
| 2010/0265146 | A1 | 10/2010 | Montgomery et al. | |
| 2011/0128187 | A1 | 6/2011 | Ju et al. | |
| 2012/0007782 | A1* | 1/2012 | Nishio ..... | H01Q 5/371 343/700 MS |
| 2014/0203987 | A1 | 7/2014 | Itoh et al. | |
| 2015/0288071 | A1 | 10/2015 | Toyao | |
| 2016/0294048 | A1 | 10/2016 | Xu et al. | |
| 2017/0117612 | A1 | 4/2017 | Toyao et al. | |
| 2018/0351231 | A1 | 12/2018 | Sarkis et al. | |
| 2020/0252042 | A1 | 8/2020 | Mori et al. | |
| 2020/0411975 | A1 | 12/2020 | Hashiguchi | |
| 2020/0412024 | A1 | 12/2020 | Hashiguchi | |

FOREIGN PATENT DOCUMENTS

| | | | |
|---|---|---|---|
| JP | 2018-174585 | A | 11/2018 |
| JP | 2018-537037 | A | 12/2018 |

OTHER PUBLICATIONS

Office Action in U.S. Appl. No. 16/848,911, dated Jan. 28, 2021.
Office Action in U.S. Appl. No. 16/848,911, dated Jun. 29, 2021.
Extended European Search Report in EP 20159316.7-1205 dated Sep. 16, 2020.

* cited by examiner

ANTENNA

CROSS REFERENCE TO RELATED APPLICATIONS

This application is based on and claims priority under 35 U.S.C. § 119 to Japanese Patent Application No. JP2019-078218 filed Apr. 17, 2019, the contents of which are incorporated herein in their entireties by reference.

BACKGROUND OF THE INVENTION

This invention relates to an antenna comprising a facing portion.

JPA2018-174585 (Patent Document 1) discloses an antenna 900 of this type. Referring to FIG. 10, the antenna 900 of Patent Document 1 comprises a capacitor 910, or a facing portion 910, a ground 920, a coaxial feed probe 930, or a first feed terminal 930, and a plurality of vias 940, or second feed terminals 940. The facing portion 910 has a first plate surface 912, or a first facing portion 912, and a second plate surface 914, or a second facing portion 914. The first facing portion 912 and the second facing portion 914 are spaced away from each other by an interdigital slot 918 in a right-left direction, or in a Y-direction.

The antenna 900 of Patent Document 1 has a drawback that, when the first facing portion 912 and the second facing portion 914 are relatively moved with respect to each other in an up-down direction, or in a Z-direction, capacitance of the capacitor 910 constituted by the first facing portion 912 and the second facing portion 914 is changed so that antenna characteristics of the antenna 900 is changed.

SUMMARY OF THE INVENTION

It is therefore an object of the present invention to provide an antenna which has little variation in antenna characteristics even if a first facing portion and a second facing portion are relatively moved with respect to each other in an up-down direction.

One aspect of the present invention provides an antenna comprising a main portion, a facing portion, a first feed terminal and a second feed terminal. The main portion has a ring shape with a split. The main portion has a first end portion and a second end portion. The first end portion and the second end portion are positioned away from each other in a right-left direction with the split left therebetween. The facing portion includes a first facing portion and a second facing portion. The first facing portion is provided on the first end portion. The second facing portion is provided on the second end portion. The first facing portion and the second facing portion are spaced away from each other. The first facing portion has an upper facing portion and a lower facing portion. The second facing portion is interposed between the upper facing portion and the lower facing portion in an up-down direction perpendicular to the right-left direction.

The antenna according to one aspect of the present invention is configured as follows: the first facing portion has the upper facing portion and the lower facing portion; and the second facing portion is interposed between the upper facing portion and the lower facing portion in the up-down direction. For example, if the second facing portion approaches the upper facing portion to increase capacitance between the second facing portion and the upper facing portion, the second facing portion is moved away from the lower facing portion to decrease capacitance between the second facing portion and the lower facing portion. Similarly, if the second facing portion approaches the lower facing portion to increase the capacitance between the second facing portion and the lower facing portion, the second facing portion is moved away from the upper facing portion to decrease the capacitance between the second facing portion and the upper facing portion. Thus, even if the second facing portion is relatively moved with respect to the first facing portion in the up-down direction, capacitance of a capacitor constituted by the first facing portion and the second facing portion is prevented from being changed. In other words, the antenna of the present invention has little variation in antenna characteristics even if the first facing portion and the second facing portion are relatively moved with respect to each other in the up-down direction.

An appreciation of the objectives of the present invention and a more complete understanding of its structure may be had by studying the following description of the preferred embodiment and by referring to the accompanying drawings.

Figure 1:
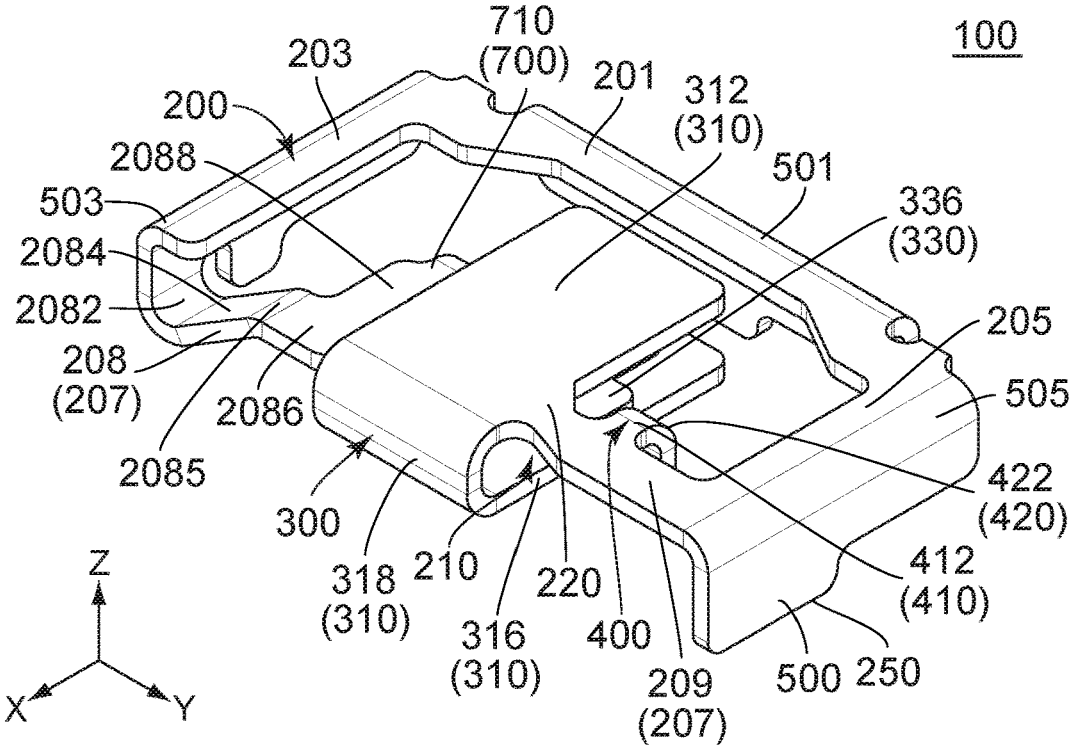
FIG. 1 is an upper perspective view showing an antenna according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 5:
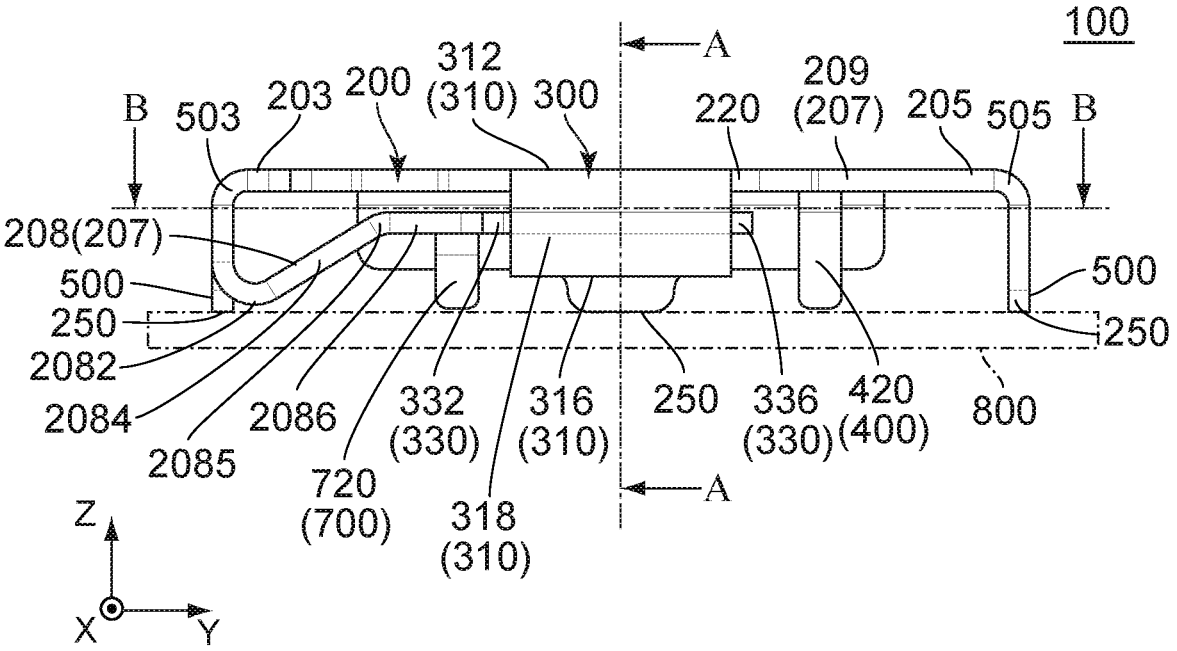
FIG. 5 is a front view showing the antenna of FIG. 1. In the figure, an object is illustrated by dotted line.

As shown in FIG. 5, an antenna 100 according to an embodiment of the present invention is mountable on an object 800. The object 800 of the present embodiment is, for, example, a printed circuit board. The object 800 has an antenna mounting surface (not shown). The antenna mounting surface is formed with a plurality of connecting pads (not shown). The object 800 further comprises a feed line (not shown) and a ground plane (not shown).

Figure 3:
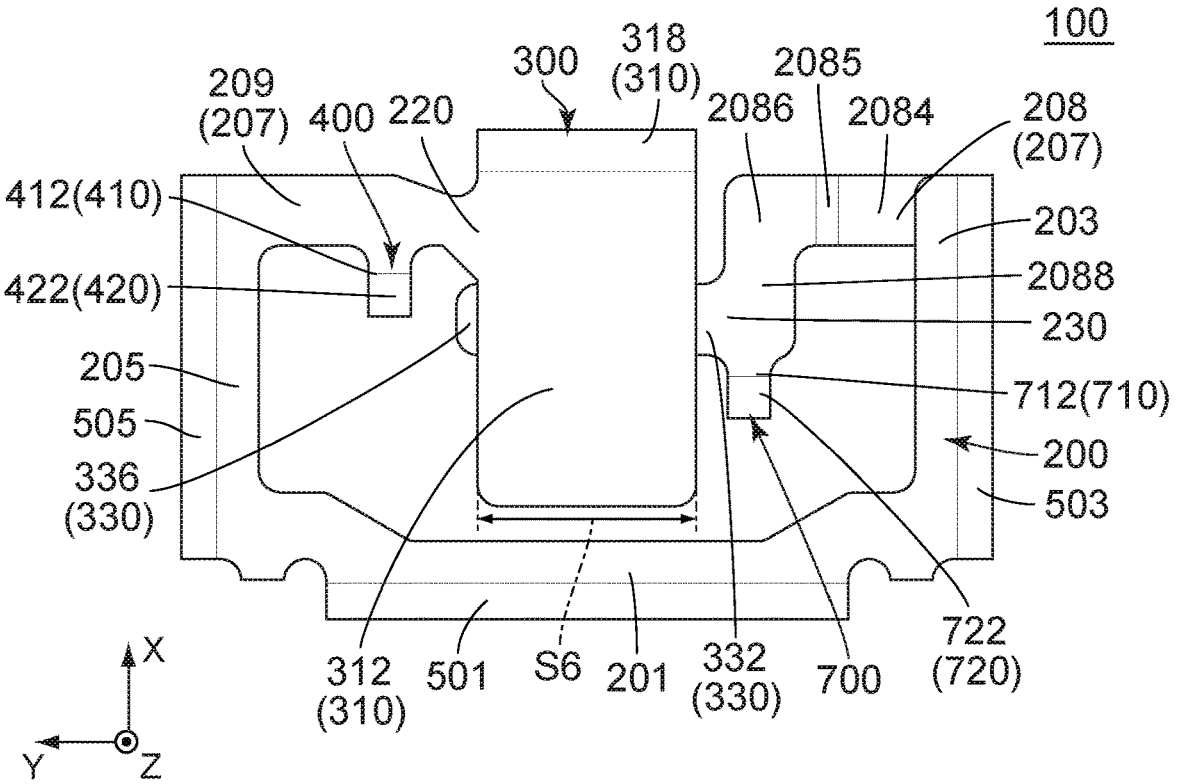
FIG. 3 is a top view showing the antenna of FIG. 1.
Figure 4:
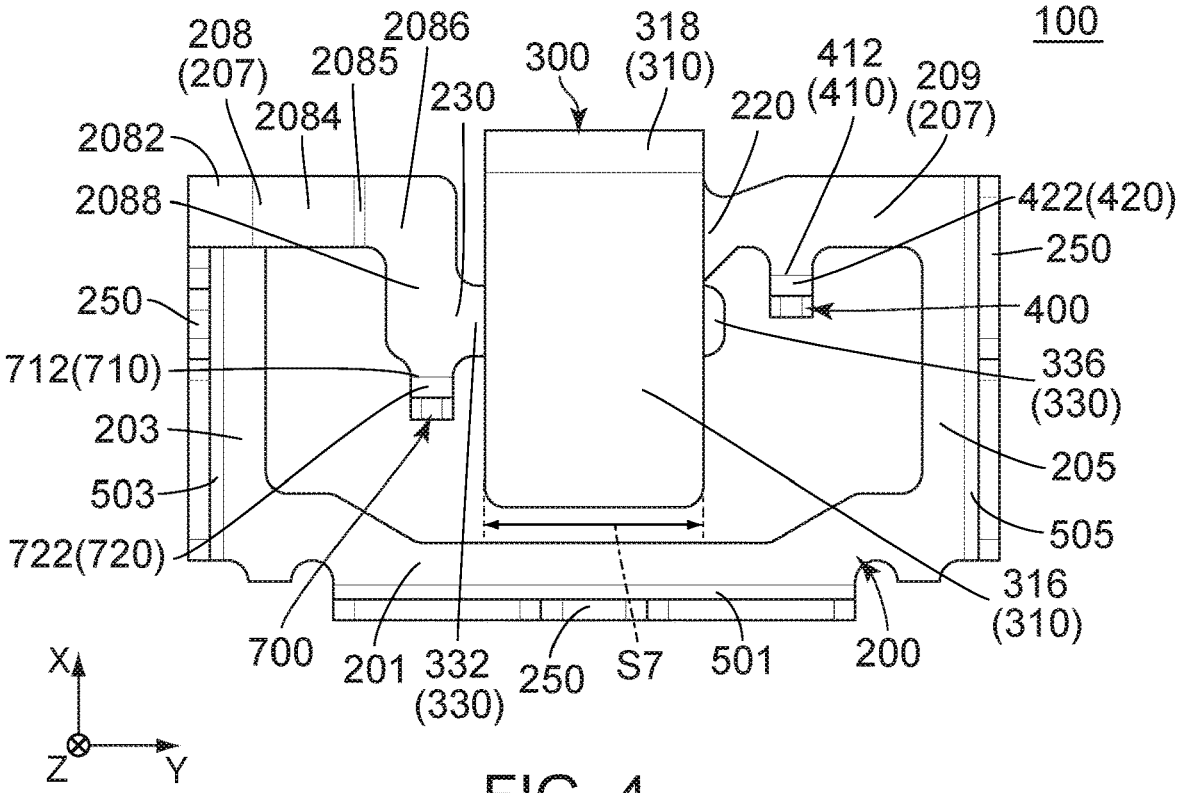
FIG. 4 is a bottom view showing the antenna of FIG. 1.
Figure 9:
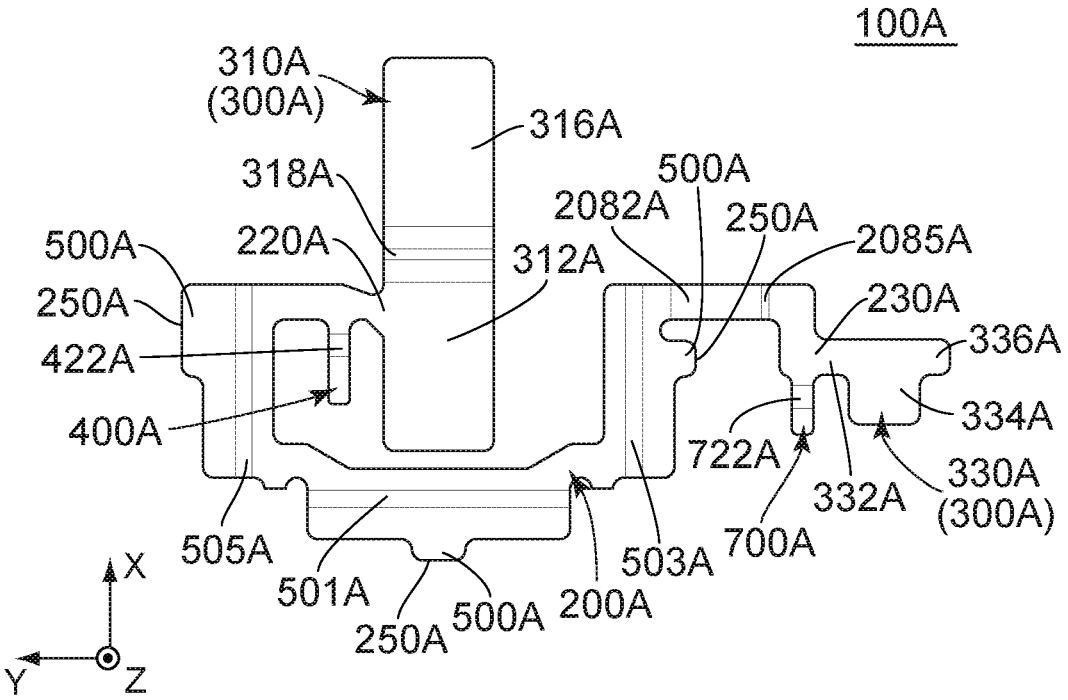
FIG. 9 is a top view showing a blank for the antenna of FIG. 1.
Figure 10:
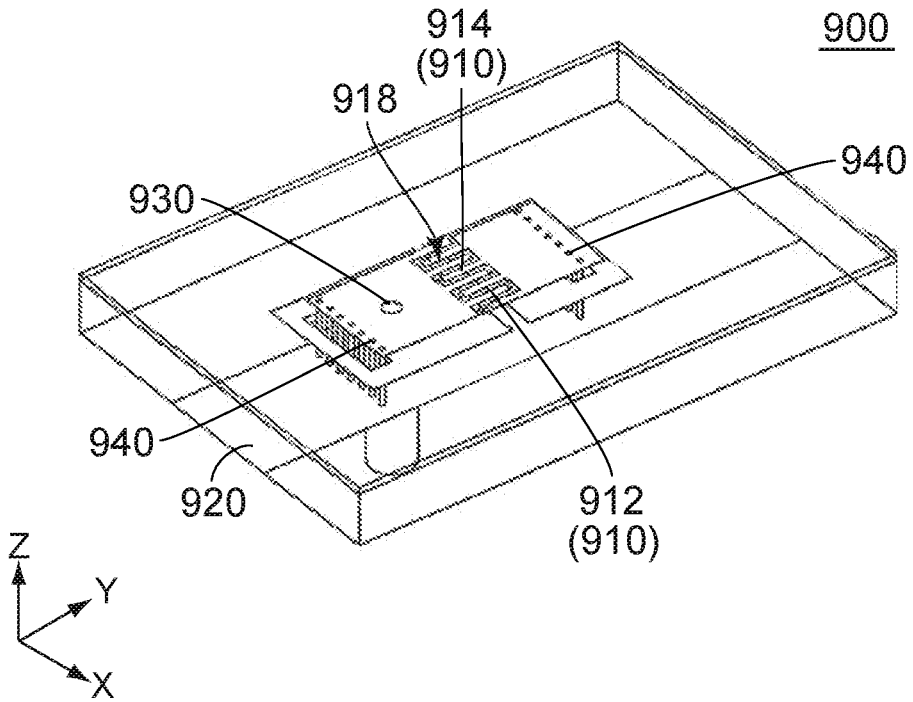
FIG. 10 PRIOR ART
FIG. 10 is an upper perspective view showing an antenna of Patent Document 1.

Referring to FIGS. 3 and 4, the antenna 100 of the present embodiment is formed from a single metal plate which has a plurality of bent portions 2082, 2085, 318, 422, 501, 503, 505 and 722. The antenna 100 of the present embodiment forms a split ring resonator. In other words, the antenna 100 of the present embodiment is a resonant antenna. Referring to FIG. 9, the antenna 100 is a discrete member which is formed by punching out a blank 100A from a single metal plate, followed by bending the blank 100A. The blank 100A and a process for bending the blank 100A are described later.

Figure 2:
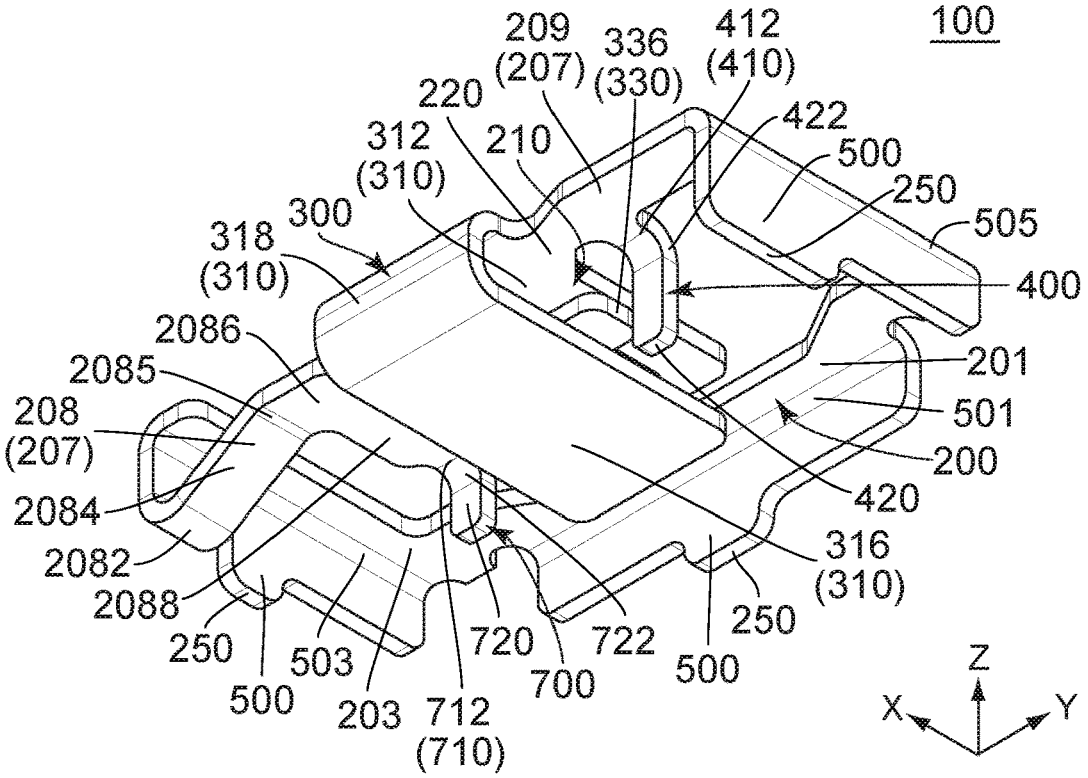
FIG. 2 is a lower perspective view showing the antenna of FIG. 1.

As shown in FIGS. 1 and 2, the antenna 100 of the present embodiment comprises a main portion 200, a facing portion 300, a first feed terminal 400, three second feed terminals 500 and an additional terminal 700. However, the present embodiment is not limited thereto. The number of the second feed terminal 500 may be one or more.

Referring to FIG. 3, the main portion 200 of the present embodiment constitutes an inductance of the antenna 100. As shown in FIGS. 2 and 3, the main portion 200 has a ring shape with a split 210. More specifically, the main portion 200 has a substantially rectangular ring shape with four sides. The wording "ring shape" as used herein includes not only an annular shape but also an elliptical annular shape and a polygonal annular shape.

As shown in FIG. 3, the main portion 200 has a first side 201, a second side 203, a third side 205 and a fourth side 207. The first side 201 extends in a right-left direction. The second side 203 and the third side 205 extend forward in a front-rear direction from opposite ends, respectively, of the first side 201 in the right-left direction. The fourth side 207 is positioned between a front end of the second side 203 and a front end of the third side 205 in the right-left direction. In the present embodiment, the right-left direction is a Y-direction. Specifically, it is assumed that rightward is a negative Y-direction while leftward is a positive Y-direction. In the present embodiment, the front-rear direction is an X-direction. Specifically, forward is a positive X-direction while rearward is a negative X-direction.

As shown in FIG. 3, the first side 201 defines a rear end of the main portion 200. The first side 201 has the bent portion 501. The second side 203 defines a right end of the main portion 200. The second side 203 has the bent portion 503. The third side 205 defines a left end of the main portion 200. The third side 205 has the bent portion 505.

As shown in FIG. 3, the fourth side 207 defines a front end of the main portion 200. The fourth side 207 consists of a right portion 208 and a left portion 209. The right portion 208 and the left portion 209 are not directly coupled with each other. The left portion 209 is positioned left of the right portion 208 in the right-left direction.

As shown in FIG. 4, the right portion 208 extends leftward in the right-left direction from the second side 203 and then extends rearward in the front-rear direction. The right portion 208 has a first bent portion (bent portion) 2082, a first straight portion 2084, a second bent portion (bent portion) 2085, a corner portion 2086 and a second straight portion 2088.

As shown in FIG. 2, the first bent portion 2082 couples a lower end of the second side 203 and the first straight portion 2084 with each other. The first straight portion 2084 extends leftward in the right-left direction and upward in an up-down direction from the first bent portion 2082. In the present embodiment, the up-down direction is a Z-direction. Specifically, upward is a positive Z-direction while downward is a negative Z-direction. A left end of the first straight portion 2084 is coupled with the second bent portion 2085. A left end of the second bent portion 2085 is coupled with the corner portion 2086. The corner portion 2086 couples the second bent portion 2085 and the second straight portion 2088 with each other. The second straight portion 2088 extends rearward in the front-rear direction from the corner portion 2086.

As shown in FIG. 3, the left portion 209 extends rightward in the right-left direction from the third side 205.

As shown in FIG. 4, the main portion 200 of the present embodiment is provided with a plurality of fixed portions 250. More specifically, the main portion 200 is provided with three of the fixed portions 250. The three fixed portions 250 are provided on outer edges of the first side 201, the second side 203 and the third side 205, respectively, of the main portion 200. Dissimilarly, an outer edge of the fourth side 207 of the main portion 200 is provided with no fixed portion. As shown in FIG. 5, each of the fixed portions 250 is also a lower end of the antenna 100. When the antenna 100 is mounted on the object 800, the fixed portions 250 of the first side 201, the second side 203 and the third side 205 of the main portion 200 are fixed to the object 800. Since the outer edge of the fourth side 207 of the main portion 200 is provided with no fixed portion as described above, the outer edge of the fourth side 207 is not fixed to the object 800 when the antenna 100 is mounted on the object 800.

As shown in FIG. 3, the main portion 200 of the present embodiment has a first end portion 220 and a second end portion 230.

As understood from FIGS. 2 and 3, the first end portion 220 and the second end portion 230 of the present embodiment are positioned away from each other in the right-left direction with the split 210 left therebetween. The first end portion 220 is positioned left of the second end portion 230 in the right-left direction. The split 210 also separates the first end portion 220 and the second end portion 230 from each other in the up-down direction. In other words, the first end portion 220 and the second end portion 230 are positioned at positions different from each other in the up-down direction. The first end portion 220 is provided on the left portion 209 of the fourth side 207 of the main portion 200. The second end portion 230 is provided on the second straight portion 2088 of the right portion 208 of the fourth side 207 of the main portion 200.

Figure 6:
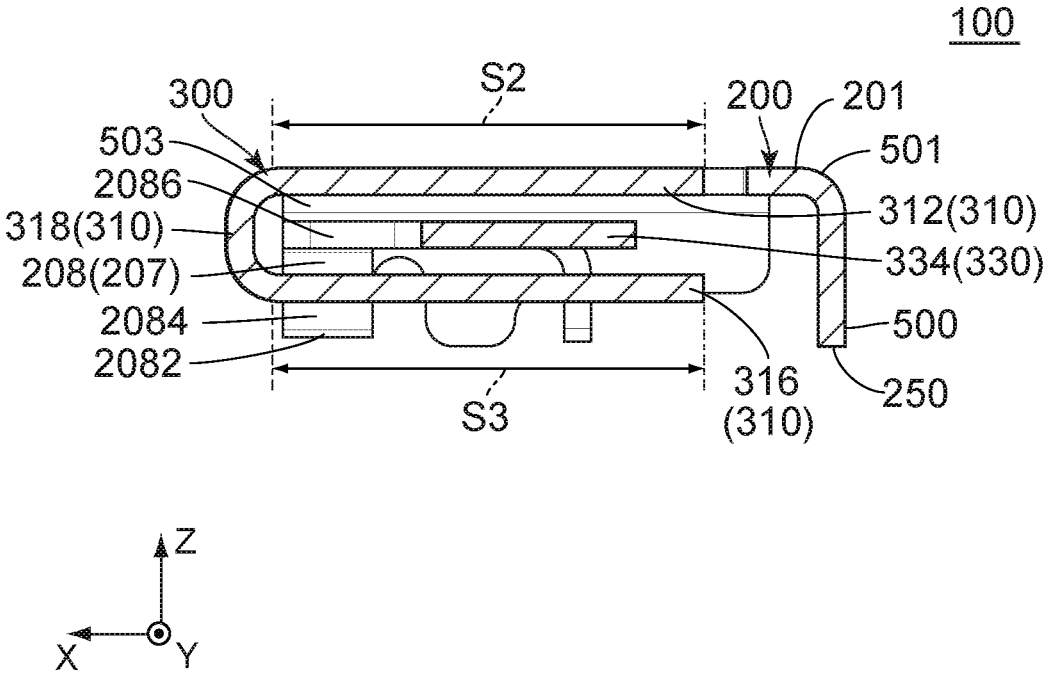
FIG. 6 is a cross-sectional view showing the antenna of FIG. 5, taken along line A-A. In the figure, the object is omitted.
Figure 7:
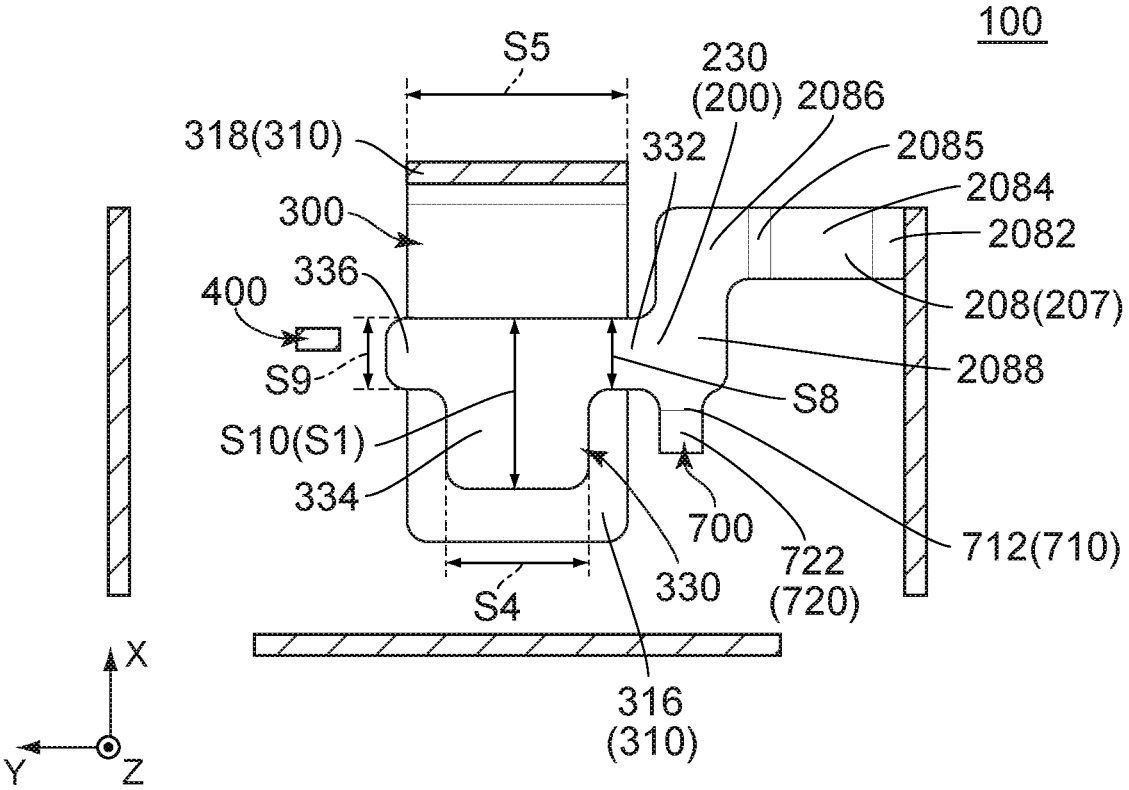
FIG. 7 is a cross-sectional view showing the antenna of FIG. 5, taken along line B-B. In the figure, the object is omitted.
Figure 8:
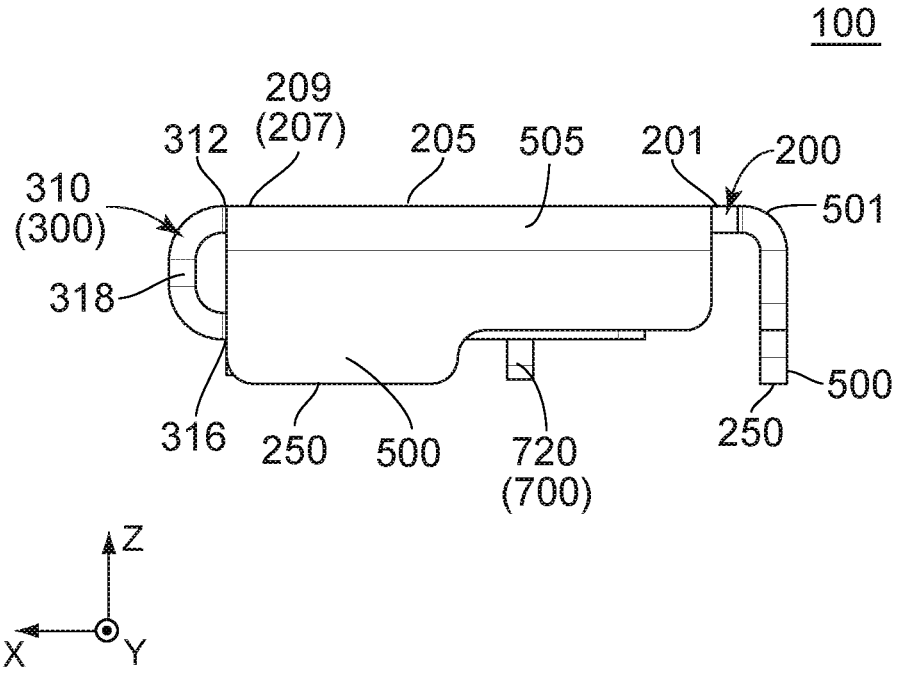
FIG. 8 is a side view showing the antenna of FIG. 1.

Referring to FIG. 6, the facing portion 300 of the present embodiment constitutes a capacitor of the antenna 100. Since the main portion 200 constitutes the inductance of the antenna 100 as described above, the facing portion 300 and the main portion 200 form an LC resonator circuit. As shown in FIG. 3, a rear end of the facing portion 300 is not coupled with the main portion 200. The facing portion 300 is positioned between the second side 203 and the third side 205 of the main portion 200 in the right-left direction. As shown in FIGS. 3 and 7, the facing portion 300 has a first facing portion 310 and a second facing portion 330. Specifically, the first facing portion 310 is provided on the first end portion 220, and the second facing portion 330 is provided on the second end portion 230.

As shown in FIG. 6, the first facing portion 310 and the second facing portion 330 of the present embodiment are spaced away from each other.

As shown in FIGS. 1 and 2, the first facing portion 310 of the present embodiment has an upper facing portion 312, a lower facing portion 316 and a coupling portion 318.

As shown in FIGS. 1 and 2, the upper facing portion 312 of the present embodiment has a flat plate shape. Specifically, the upper facing portion 312 has a flat plate shape perpendicular to the up-down direction. The upper facing portion 312 extends directly from the first end portion 220. More specifically, the upper facing portion 312 extends rightward in the right-left direction directly from the first end portion 220. Since the upper facing portion 312 of the present embodiment has the aforementioned structure, the whole of the antenna 100 can be lift up by picking the upper facing portion 312 up by the use of a vacuum chuck. Thus, the antenna 100 of the present embodiment can be handled in an automatic component feeder system.

As shown in FIG. 2, the lower facing portion 316 of the present embodiment has a flat plate shape. Specifically, the lower facing portion 316 has a flat plate shape perpendicular to the up-down direction. As shown in FIG. 6, the lower facing portion 316 is positioned below the upper facing portion 312 in the up-down direction. As shown in FIGS. 3 and 4, the lower facing portion 316 has a shape same as the upper facing portion 312. Referring to FIGS. 3, 4 and 6, in the front-rear direction, the lower facing portion 316 has a size S3 equal to a size S2 of the upper facing portion 312. Additionally, in the right-left direction, the lower facing portion 316 has a size S7 equal to a size S6 of the upper facing portion 312.

As shown in FIG. 3, the coupling portion 318 is positioned at a position different from a position of the first end portion 220 in the front-rear direction perpendicular to both the up-down direction and the right-left direction. As shown in FIG. 6, the coupling portion 318 of the present embodiment has a sideways U cross-section in a plane perpendicular to the right-left direction. A front end of the coupling portion 318 is a front end of the antenna 100. The coupling portion 318 couples the upper facing portion 312 and the lower facing portion 316 with each other. More specifically, the coupling portion 318 couples a front end of the upper facing portion 312 and a front end of the lower facing portion 316 with each other. The lower facing portion 316 extends from the upper facing portion 312 via the coupling portion 318. However, the present invention is not limited thereto. The antenna 100 may be modified so that the lower facing portion 316 extends directly from the first end portion 220 while the upper facing portion 312 extends from the lower facing portion 316 via the coupling portion 318. In other words, the antenna 100 may be modified, provided that one of the upper facing portion 312 and the lower facing portion 316 extends directly from the first end portion 220 while a remaining one of the upper facing portion 312 and the lower facing portion 316 extends from the one of the upper facing portion 312 and the lower facing portion 316 via the coupling portion 318. The antenna 100 of the present embodiment is, however, preferred because the antenna 100 of the present embodiment has a reduced size in the up-down direction.

As shown in FIG. 7, the second facing portion 330 of the present embodiment has a flat plate shape. Specifically, the second facing portion 330 has a flat plate shape perpendicular to the up-down direction. As shown in FIG. 6, the second facing portion 330 is interposed between the upper facing portion 312 and the lower facing portion 316 in the up-down direction perpendicular to the right-left direction. Thus, when the second facing portion 330 is relatively moved to approach the upper facing portion 312 in the up-down direction, capacitance between the second facing portion 330 and the upper facing portion 312 is increased. Meanwhile, the second facing portion 330 is relatively moved away from the lower facing portion 316 in the up-down direction, so that capacitance between the second facing portion 330 and the lower facing portion 316 is decreased. Thus, capacitance of a capacitor constituted by the first facing portion 310 and the second facing portion 330 is prevented from being changed if the second facing portion 330 is relatively moved to approach the upper facing portion 312 in the up-down direction. When the second facing portion 330 is relatively moved to approach the lower facing portion 316 in the up-down direction, the capacitance between the second facing portion 330 and the lower facing portion 316 is increased. Meanwhile, the second facing portion 330 is relatively moved away from the upper facing portion 312 in the up-down direction, so that the capacitance between the second facing portion 330 and the upper facing portion 312 is decreased. Thus, the capacitance of the capacitor constituted by the first facing portion 310 and the second facing portion 330 is prevented from being changed if the second facing portion 330 is relatively moved to approach the lower facing portion 316 in the up-down direction. In other word, the capacitance of the capacitor constituted by the first facing portion 310 and the second facing portion 330 is prevented from being changed if the second facing portion 330 is relatively moved with respect to the first facing portion 310 in the up-down direction. As described above, the antenna 100 of the present embodiment has little variation in antenna characteristics even if the first facing portion 310 and the second facing portion 330 are relatively moved with respect to each other in the up-down direction.

Referring to FIGS. 6 and 7, in the front-rear direction perpendicular to both the up-down direction and the right-left direction, a size S1 of the second facing portion 330 is smaller than any of the size S2 of the upper facing portion 312 and the size S3 of the lower facing portion 316. Thus, if the second facing portion 330 is relatively moved with respect to each of the upper facing portion 312 and the lower facing portion 316 in the front-rear direction, the capacitance between the second facing portion 330 and the upper facing portion 312 is hardly changed while the capacitance between the second facing portion 330 and the lower facing portion 316 is hardly changed. In other words, the capacitance of the capacitor constituted by the first facing portion 310 and the second facing portion 330 is hardly changed even if the second facing portion 330 is relatively moved with respect to the first facing portion 310 in the front-rear direction. Thus, the antenna 100 of the present embodiment has little variation in antenna characteristics even if the first facing portion 310 and the second facing portion 330 are relatively moved with respect to each other in the front-rear direction.

As shown in FIG. 7, the second facing portion 330 of the present embodiment has a connecting portion 332, a main facing portion 334 and a protruding portion 336.

Referring to FIG. 7, the connecting portion 332 of the present embodiment has a flat plate shape perpendicular to the up-down direction. The connecting portion 332 connects the second end portion 230 and the main facing portion 334 with each other. More specifically, the connecting portion 332 connects the second end portion 230 and the main facing portion 334 with each other in the right-left direction. As shown in FIGS. 3 and 4, when the antenna 100 is viewed along the up-down direction, a part of the connecting portion 332 does not overlap with any of the upper facing portion 312 and the lower facing portion 316 while a remaining part of the connecting portion 332 overlaps with any of the upper facing portion 312 and the lower facing portion 316. In other words, the connecting portion 332 partially overlaps with any of the upper facing portion 312 and the lower facing portion 316.

Referring to FIG. 7, the main facing portion 334 of the present embodiment has a flat plate shape perpendicular to the up-down direction. In the right-left direction, the main facing portion 334 has a size S4 smaller than a size S5 of the first facing portion 310. In the front-rear direction, the main facing portion 334 has a size S10 equal to the size S1 of the second facing portion 330.

Referring to FIG. 7, the protruding portion 336 of the present embodiment has a flat plate shape perpendicular to the up-down direction. The protruding portion 336 and the connecting portion 332 sandwich the main facing portion 334 therebetween. The protruding portion 336 protrudes from the main facing portion 334 in a direction far from the connecting portion 332. Specifically, the protruding portion 336 protrudes from the main facing portion 334 in a first orientation of the right-left direction, and the connecting portion 332 extends from the main facing portion 334 in a second orientation which is opposite to the first orientation. In the present embodiment, the first orientation is a positive Y-direction while the second orientation is a negative Y-direction. In the front-rear direction, the protruding portion 336 has a size S9 equal to a size S8 of the connecting portion 332. In the front-rear direction, the size S10 of the main facing portion 334 is greater than any of the size S8 of the connecting portion 332 and the size S9 of the protruding portion 336. As shown in FIGS. 3 and 4, when the antenna 100 is viewed along the up-down direction, a part of the protruding portion 336 does not overlap with any of the upper facing portion 312 and the lower facing portion 316 while a remaining part of the protruding portion 336 overlaps with any of the upper facing portion 312 and the lower facing portion 316. In other words, the protruding portion 336 partially overlaps with any of the upper facing portion 312 and the lower facing portion 316.

Again, the antenna 100 of the present embodiment is configured as follows: in the right-left direction, the size S4 of the main facing portion 334 is smaller than the size S5 of the first facing portion 310; in the front-rear direction, the size S9 of the protruding portion 336 is equal to the size S8 of the connecting portion 332; and each of the part of the connecting portion 332 and the part of the protruding portion 336 does not overlap with any of the upper facing portion 312 and the lower facing portion 316 when the antenna 100 is viewed along the up-down direction. Thus, the antenna 100 of the present embodiment is configured so that, even if the second facing portion 330 is relatively moved with respect to each of the upper facing portion 312 and the lower facing portion 316 in the right-left direction, the capacitance between the second facing portion 330 and the upper facing portion 312 is hardly changed while the capacitance between the second facing portion 330 and the lower facing portion 316 is hardly changed. In other words, the capacitance of the capacitor constituted by the first facing portion 310 and the second facing portion 330 is hardly changed even if the second facing portion 330 is relatively moved with respect to the first facing portion 310 in the right-left direction. Thus, the antenna 100 of the present embodiment has little variation in antenna characteristics even if the first facing portion 310 and the second facing portion 330 are relatively moved with respect to each other in the right-left direction.

As shown in FIG. 5, the first feed terminal 400 of the present embodiment is fixed to the object 800 when the antenna 100 is mounted on the object 800. More specifically, the first feed terminal 400 is electrically connected to the feed line (not shown) via the connecting pad (not shown) of the object 800 when the antenna 100 is mounted on the object 800.

As shown in FIG. 3, the first feed terminal 400 is provided on the main portion 200. In detail, the first feed terminal 400 is provided on the left portion 209 of the fourth side 207 of the main portion 200. Specifically, the first feed terminal 400 extends from the left portion 209 of the fourth side 207 of the main portion 200.

As shown in FIG. 2, on the main portion 200, the first feed terminal 400 is positioned between the first end portion 220 and any of the second feed terminals 500. On the main portion 200, the first feed terminal 400 is nearer to the first end portion 220 than to any of the second feed terminals 500. In other words, the first feed terminal 400 is provided on the main portion 200 so that a current path between the first feed terminal 400 and the first end portion 220 is shorter than a current path between the first feed terminal 400 and any of the second feed terminals 500. The first feed terminal 400 is positioned away from the first end portion 220. More specifically, the first feed terminal 400 is positioned leftwardly away from the first end portion 220 in the right-left direction.

As shown in FIGS. 2 and 3, the first feed terminal 400 of the present embodiment has a first portion 410 and a second portion 420.

As shown in FIGS. 1 and 2, the first portion 410 of the present embodiment extends rearward in the front-rear direction from the left portion 209 of the fourth side 207 of the main portion 200. The first portion 410 has an end 412 in the front-rear direction. The end 412 of the first portion 410 is a rear end of the first portion 410.

As shown in FIG. 5, the second portion 420 of the present embodiment is fixed to the object 800 when the antenna 100 is mounted on the object 800. As shown in FIG. 2, the second portion 420 extends downward in the up-down direction from the end 412 of the first portion 410. However, the present invention is not limited thereto. The second portion 420 may be modified, provided that the second portion 420 extends in a direction, which intersects with both the front-rear direction and the right-left direction, from the end 412 of the first portion 410. The second portion 420 has a first feed terminal bent portion (bent portion) 422 at its upper end in the up-down direction. The first feed terminal bent portion 422 of the second portion 420 is coupled with the end 412 of the first portion 410 in the front-rear direction.

As shown in FIG. 5, the second feed terminal 500 of the present embodiment is fixed to the object 800 when the antenna 100 is mounted on the object 800. More specifically, the second feed terminal 500 is electrically connected to the ground plane (not shown) via both the fixed portion 250 and the connecting pad (not shown) of the object 800 when the antenna 100 is mounted on the object 800.

As shown in FIG. 2, each of the second feed terminals 500 of the present embodiment is provided on the main portion 200. More specifically, the second feed terminals 500 are provided on the first side 201, the second side 203 and the third side 205, respectively, of the main portion 200. Each of the second feed terminals 500 extends downward in the up-down direction from the main portion 200.

As shown in FIG. 5, the additional terminal 700 of the present embodiment is fixed to the object 800 when the antenna 100 is mounted on the object 800. When the additional terminal 700 is fixed to the object 800, the additional terminal 700 is not connected to any of the feed line and the ground plane of the object 800.

As shown in FIG. 3, the additional terminal 700 is provided on the main portion 200. In detail, the additional terminal 700 is provided on the right portion 208 of the fourth side 207 of the main portion 200. Specifically, the additional terminal 700 extends from the right portion 208 of the fourth side 207 of the main portion 200.

As understood from FIGS. 2 and 3, on the main portion 200, the additional terminal 700 is positioned between the second end portion 230 and any of the second feed terminals 500. On the main portion 200, the additional terminal 700 is nearer to the second end portion 230 than to any of the second feed terminals 500. The additional terminal 700 is positioned opposite the first feed terminal 400 across the facing portion 300. The additional terminal 700 is positioned right of the second end portion 230 in the right-left direction.

As shown in FIGS. 2 and 3, the additional terminal 700 has a first portion 710 and a second portion 720.

As shown in FIG. 3, the first portion 710 of the present embodiment extends rearward in the front-rear direction from the right portion 208 of the fourth side 207 of the main portion 200. The first portion 710 has an end 712 in the front-rear direction. The end 712 of the first portion 710 is a rear end of the first portion 710.

As shown in FIG. 5, the second portion 720 of the present embodiment is fixed to the object 800 when the antenna 100 is mounted on the object 800. As shown in FIG. 2, the second portion 720 extends downward in the up-down direction from the end 712 of the first portion 710. However, the present embodiment is not limited thereto. The second portion 720 may be modified, provided that the second portion 720 extends in a direction, which intersects with both the front-rear direction and the right-left direction, from the end 712 of the first portion 710. The second portion 720 has an additional terminal bent portion (bent portion) 722 at its upper end in the up-down direction. As shown in FIG. 3, the additional terminal bent portion 722 of the second portion 720 is coupled with the end 712 of the first portion 710 in the front-rear direction.

Referring to FIGS. 1 and 9, the antenna 100 is formed, as described above, by bending the blank 100A. As shown in FIG. 9, the blank 100A has a constant thickness. Specifically, the blank 100A comprises a main portion 200A, a facing portion 300A, a first feed terminal 400A, three second feed terminals 500A, an additional terminal 700A, portions 2082A, 2085A, 422A, 501A, 503A, 505A and 722A. The main portion 200A has a first end portion 220A and a second end portion 230A. Further, the main portion 200A is provided with three fixed portions 250A. The facing portion 300A has a first facing portion 310A and a second facing portion 330A. The first facing portion 310A is provided on the first end portion 220A. The second facing portion 330A is provided on the second end portion 230A. The first facing portion 310A has an upper facing portion 312A, a lower facing portion 316A and a portion 318A. The second facing portion 330A has a connecting portion 332A, a main facing portion 334A and a protruding portion 336A. The antenna 100 is formed as follows. First, each of the portions 2082A and 503A is bent to form a mountain fold. Next, the portion 2085A is bent to form a valley fold, and the portion 318A is bent to form a mountain fold. Then, the portions 422A, 501A and 505A are bent to form a mountain fold, the portion 722A is bent to form a valley fold, and the formation of the antenna 100 is completed. This bending process enables the portions 2082A, 2085A, 422A, 501A, 503A, 505A and 722A to become the bent portions 2082, 2085, 422, 501, 503, 505 and 722, respectively. Further, this bending process also enables the main portion 200A, the facing portion 300A, the first feed terminal 400A, the second feed terminals 500A and the additional terminal 700A to become the main portion 200, the facing portion 300, the first feed terminal 400, the second feed terminals 500 and the additional terminal 700, respectively. In addition, this bending process also enables the first end portion 220A, the second end portion 230A, the fixed portions 250A, the first facing portion 310A and the second facing portion 330A to become the first end portion 220, the second end portion 230, the fixed portions 250, the first facing portions 310 and the second facing portion 330, respectively. Furthermore, this bending process also enables the upper facing portion 312A, the lower facing portion 316A, the portion 318A, the connecting portion 332A, the main facing portion 334A and the protruding portion 336A to become the upper facing portion 312, the lower facing portion 316, the coupling portion (bent portion) 318, the connecting portion 332, the main facing portion 334 and the protruding portion 336, respectively.

Although the specific explanation about the present invention is made above referring to the embodiments, the present invention is not limited thereto and is susceptible to various modifications and alternative forms.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. An antenna comprising a main portion, a facing portion, a first feed terminal and a second feed terminal, wherein:

the main portion has a ring shape with a split;

the main portion has a first end portion and a second end portion;

the first end portion and the second end portion are positioned away from each other in a right-left direction with the split left therebetween;

the facing portion includes a first facing portion and a second facing portion;

the first facing portion is provided on the first end portion;

the second facing portion is provided on the second end portion;

the first facing portion and the second facing portion are spaced away from each other;

the first facing portion has an upper facing portion and a lower facing portion;

the second facing portion is interposed between the upper facing portion and the lower facing portion in an up-down direction perpendicular to the right-left direction;

the first facing portion further has a coupling portion;

the coupling portion couples the upper facing portion and the lower facing portion with each other; and the coupling portion is positioned at a position different from a position of the first end portion in a front-rear direction perpendicular to both the up-down direction and the right-left direction.

2. The antenna as recited in claim 1, wherein:

each of the upper facing portion, the lower facing portion and the second facing portion has a flat plate shape; and in a front-rear direction perpendicular to both the up-down direction and the right-left direction, the second facing portion has a size smaller than a size of any of the upper facing portion and the lower facing portion.

3. The antenna as recited in claim 1, wherein:

one of the upper facing portion and the lower facing portion extends directly from the first end portion; and a remaining one of the upper facing portion and the lower facing portion extends from the one of the upper facing portion and the lower facing portion via the coupling portion.

4. The antenna as recited in claim 1, wherein:

the second facing portion has a connecting portion, a main facing portion and a protruding portion;

the connecting portion connects the second end portion and the main facing portion with each other;

the protruding portion and the connecting portion sandwich the main facing portion therebetween;

the protruding portion protrudes from the main facing portion in a direction far from the connecting portion;

when the antenna is viewed along the up-down direction, a part of the connecting portion does not overlap with any of the upper facing portion and the lower facing portion;

when the antenna is viewed along the up-down direction, a part of the protruding portion does not overlap with any of the upper facing portion and the lower facing portion; and in the right-left direction, the main facing portion has a size smaller than a size of the first facing portion.

* * * * *